United States Patent [19]

Hunder et al.

[11] Patent Number: 5,013,200

[45] Date of Patent: May 7, 1991

[54] BINDING SYSTEM

[76] Inventors: Ray A. Hunder; Alden R. Miles; Stephen H. Dwyer; Dorman N. Thompson, all of P.O. Box 33427, St. Paul, Minn. 55133-3427

[21] Appl. No.: 328,805

[22] Filed: Mar. 20, 1989

Related U.S. Application Data

[63] Continuation of Ser. No. 194,820, May 17, 1988, abandoned.

[51] Int. Cl.[5] ..... B42C 9/00; B42B 5/00

[52] U.S. Cl. ..... 412/6; 412/8; 412/20; 412/33; 281/15.1; 281/21.1; 281/29

[58] Field of Search ..... 281/15.1, 21.1, 29; 412/6, 8, 20, 33, 37

[56] References Cited

U.S. PATENT DOCUMENTS

| | | | |
|---|---|---|---|
| 848,680 | 4/1907 | Nelson . | |
| 1,765,194 | 6/1930 | Von Auw . | |
| 1,932,153 | 10/1933 | Bergendahl | 281/15 R |
| 2,455,971 | 12/1948 | Bosch | 11/1 |
| 2,877,473 | 3/1959 | Ehlermann | 412/37 |
| 3,188,114 | 6/1965 | O'Brien et al. | 281/21 |
| 3,261,044 | 7/1966 | Hoff | 412/37 X |
| 3,292,951 | 12/1966 | Schoenberger | 412/8 |
| 3,518,143 | 6/1970 | Fuhr | 156/212 |
| 3,833,244 | 9/1974 | Heimann | 281/21 |
| 4,518,296 | 5/1985 | Pearson et al. | 412/37 |
| 4,558,888 | 12/1985 | Hanson et al. | 412/901 |
| 4,673,324 | 6/1987 | Hanson et al. | 412/6 |
| 4,697,970 | 6/1987 | Hanson | 281/15 R X |
| 4,702,659 | 10/1987 | Hanson | 281/15 R X |

FOREIGN PATENT DOCUMENTS

| | | |
|---|---|---|
| 806258 | 6/1951 | Fed. Rep. of Germany . |
| 902727 | 1/1954 | Fed. Rep. of Germany . |
| 1097407 | 1/1961 | Fed. Rep. of Germany . |
| 1126667 | 11/1956 | France . |
| 6711263 | 2/1969 | Netherlands . |

*Primary Examiner*—Paul A. Bell

[57] ABSTRACT

A binding system including a method for binding sheets in which a stack of the sheets is shingled to disclose narrow side surface portions along their spine edges, a uniform layer of pressure sensitive adhesive is adhered to those spine edges and narrow side surface portion after which the spine edges are moved into alignment at a right angle to the side surfaces of the sheets to re-form the pressure sensitive adhesive along the spines of the sheets, and a flexible backing is adhered over the re-formed adhesive along the spine edges and at the side surfaces of the sheets to retain the spine edges of the sheets in that alignment. The system also includes a novel cover structure which facilitates the method and includes cover plates, the pressure sensitive adhesive and the backing; and a novel device for holding and positioning the sheets during binding.

8 Claims, 10 Drawing Sheets

BINDING SYSTEM

This is a continuation of application Ser. No. 194,820, filed May 17, 1988, now abandoned.

TECHNICAL FIELD

The present invention relates to systems for binding sheets (i.e., separate sheets or connected fan folded sheets) using pressure sensitive adhesive, which systems include cover structures and devices used in binding such sheets and the bound documents produced by such systems.

BACKGROUND ART

The art describes systems for binding sheets using adhesives including pressure sensitive adhesive, which systems include cover structures and/or devices used in binding such sheets and produce various types of bound documents. Many such systems have included methods and devices adapted for binding sheets by disposing the sheets in a stack with narrow side surface portions of the sheets adjacent their spine edges exposed beyond the spine edges of overlying sheets, and applying a layer of adhesive over the spine edges and exposed narrow side surface portions to bind the stack. Such a system in which a layer of pressure sensitive adhesive already adhered to a flexible backing is adhered over the spine edges and exposed narrow side surface portions so that the flexible backing and layer of pressure sensitive adhesive bind the stack into a bound document is described in U.S. Pat. No. 3,188,144.

While such systems produce useful bound documents that can be formed by persons with no particular binding skill in offices or homes without the need for passing mechanical binding devices through openings in the sheets that can obstruct information on the sheets and restrict easy opening of the document, known documents of this type have a somewhat unconventional appearance and are somewhat limited in the number of sheets that can be conveniently bound due to the offset spine edges of the bound sheets.

DISCLOSURE OF INVENTION

The present invention provides an effective system for binding sheets using pressure sensitive adhesive which persons in offices or homes with no particular binding skill can use to form a bound document from a large number of sheets, in which bound document the spine edges of the bound sheets are aligned in a plane at a right angle to side surfaces of the stack of sheets in the document to provide a conventional appearance for the bound document, and which bound document can be opened so that the sheets to which the document is opened lay completely flat to facilitate viewing and photocopying any information thereon.

The system according to the present invention includes a method for binding a stack of sheets to form a bound document comprising the steps of (1) disposing the sheets in a stack having side surfaces with narrow side surface portions of the sheets adjacent their spine edges exposed beyond the spine edges of overlying sheets; (2) pressing a generally uniformly thick first layer of pressure sensitive adhesive over the spine edges and exposed narrow side surface portions; (3) moving the sheets to a position with the spine edges of the sheets generally aligned in a plane generally at a right angle to the side surfaces of the stack to re-form the first layer of pressure sensitive adhesive so that a major portion thereof extends in a generally uniformly thick layer along the spine edges of the sheets and minor portions thereof extend between the narrow side surface portions of the sheets to retain adhesion of the first layer of pressure sensitive adhesive to the spine edges and the narrow side surface portions; and (4) adhering a generally planar central portion of a strong flexible backing over the major portion of the first layer of pressure sensitive adhesive on its side opposite the spine edges, preferably through the use of a second layer of pressure sensitive adhesive already adhered to the flexible backing, and attaching end portions of the flexible backing at the sides of the stack to retain the spine edges of the sheets in a plane at generally a right angle to the side surfaces of the stack.

This novel method can be used to form bound documents either with sheets that are entirely separate from each other with each of the sheets having one of the narrow side surface portions to which the first layer of adhesive is adhered that preferably has a width in a direction at a right angle to its spine edge that is at least 3 times the thickness of the sheet; or with sheets that are joined at their edges to sheets adjacent their major surfaces in the stack in the manner of a fan fold with the spine edge of each sheet (other than the outermost sheets in the stack which are only joined along one edge) joined to the spine edge of the sheet along one of its side surfaces, and the outer edge of the sheet joined to the outer edge of the sheet along the other of its side surfaces with every other sheet in the stack having one of the narrow side surface portions to which the first layer of adhesive is adhered that also preferably has a width in a direction at a right angle to its spine edge that is at least 3 times the thickness of one of the sheets.

This novel method produces a novel bound document comprising (1) the multiplicity of similarly sized sheets in a stack with the spine edges of the sheets aligned to define a generally planar surface at a right angle to the opposite side surfaces of the stack; (2) the re-formed first layer of pressure sensitive adhesive with its major portion extending in a generally uniform layer along the spine edges of the sheets and its minor portions extending between the narrow side surface portions of the sheets to retain adhesion of the first layer of pressure sensitive adhesive to the spine edges and the narrow side surface portions; and (3) the flexible backing which has a generally planar central portion overlying and adhered to the side of the major portion of the first layer of pressure sensitive adhesive opposite the spine edges and end portions attached at the opposite side surfaces of the stack to retain the spine edges in a plane at generally a right angle to the side surfaces of the stack.

Pressure sensitive adhesives that are suitable as the layer of pressure sensitive adhesive in the binding system described above should produce a page pull test value of more than 2 pounds per inch of bound length when a document bound by the adhesive is tested in accordance with the page pull test specified in Government Publication Office Publication 310.1, Section F-5.2 (a copy of which can be obtained from the U.S. Government Printing Office, Washington, D.C., the content whereof is incorporate herein by reference), which page pull test generally comprises opening a document bound using the adhesive, and pulling one page vertically from the opened document while measuring the force required to remove the page.

The adhesive should also survive 125 or more page flex cycles when a document bound by the adhesive is tested in accordance with the page flex test specified in Government Publication Office Publication 310.1, Section F-5.3 (a copy of which can be obtained from the United States Government Printing Office, Washington, D.C., the content whereof is incorporate herein by reference), which page flex test generally comprises opening a document bound using the adhesive on a vertical surface, holding each side of the opened document firmly in place, and flexing a single sheet back and forth while pulling upwardly on the sheet with a force of 2.5 pounds until failure occurs as separation of the sheet from the book or until a predetermined number of flexures is achieved.

Additionally, the adhesive should achieve acceptable results when tested by a somewhat subjective open book test in which a document bound using the adhesive is opened at the middle of the document, one half of the document is supported on a vertical support surface 1 inch high with the other half being unsupported so that the weight of the other half tends to peel the adhesive away from the uppermost pages in the supported half. The length of the test is 3 days, with observations being made at 3 days for any sheets that have come loose or gapping between the top sheet and sheets lying beneath the top sheet on the supported half. At the end of the third day, the page pull test described above is performed on the uppermost page of the supported half, with a a page pull test value of more than 0.5 pounds per inch of bound length being acceptable.

Pressure sensitive adhesives that are suitable as the layer of pressure sensitive adhesive in the binding system described above when applied at a coating weight of about 30 grains per 24 square inches include a tackified, cross linked acrylic adhesive described in U.S. Pat. No. 4,418,120 (incorporated herein by reference), which is a copolymer in a 94:6 ratio of isooctylacrylate to acrylic acid, containing a tackifying rosin ester and an antioxidant; and tackified block copolymers typified by tackified block copolymers containing styrene and diene components, and tackified by polymerized pinene resin, and stabilized with antioxidants and U. V. light inhibitors.

A preferred pressure sensitive adhesive for use as as the layer of pressure sensitive adhesive in the binding system described above which is easy to apply and after application exceeds the requirements for the tests set forth above is an acrylic-macromer pressure sensitive adhesive consisting of 100 parts by weight of a polymer consisting of 92 percent by weight of isooctyl acrylate, 4 percent by weight of acrylamide and 4 percent by weight of polystyrene macromer; and 40 parts by weight of a tackifier commercially available as "Foral 85" from Hercules, Inc., Wilmington, Del.

The novel method described above can be performed using a novel cover structure comprising (1) a first cover assembly including a first cover plate having a spine edge, an inner surface adapted to be placed adjacent one side surface of the stack, and an outer surface, first and second release liners projecting from the spine edge of the first cover plate with the first liner adjacent the outer surface, the second liner on the side of the first liner opposite the first cover plate, and the first layer of pressure sensitive adhesive between and releasably adhered to both of the liners, the flexible backing having an edge portion attached to a portion of the outer surface of the first cover plate adjacent its spine edge and projecting past its spine edge along the side of the second liner opposite the first liner, and the second layer of pressure sensitive adhesive being firmly adhered to the projecting portion of the flexible backing adjacent the second release liner and releasably adhered to the second release liner to attach the first and second liners and the first layer of pressure sensitive adhesive therebetween to the first cover plate; and (2) a second cover assembly including a second cover plate having a spine edge, an inner surface adapted to be placed adjacent the side surface of the stack opposite the first cover plate with its spine edge aligned with the spine edge of the stack, and a disposable plate, which disposable plate is separably attached edge to edge to the second cover plate along its spine edge. The cover plates are positioned on opposite sides of the stack with the spine edges of the cover plates aligned with the spine edges of the sheets during the disposing step. The first liner is removed from the first cover assembly prior to the pressing step, the first layer of pressure sensitive adhesive is pressed against the spine edges and narrow side surface portions of the sheets in the stack and against the disposable plate of the second cover assembly through the second liner during the pressing step, the second liner is removed after the applying step and prior to the moving step so that the layer of adhesive will re-form itself along the spine edges and narrow side surface portions of the sheets, the disposable plate is removed from the second cover plate after the pressing step to remove any portion of the first layer of pressure sensitive adhesive extending beyond the stack, and an edge portion of the reinforcing strip is adhered to a portion of the second cover plate sheet adjacent its spine edge during the applying step to complete attachment of the ends of the flexible backing at the sides of the stack.

This use of the method in conjunction with the cover structure results in a novel bound document of the type described above which additionally has the pair of cover plates disposed on the opposite side surfaces of the stack with their spine edges aligned with the spine edges of the sheets in the stack with end portions of the flexible backing attached to the cover plates.

The system according to the present invention further includes a device that facilitates binding of the sheets and comprises positioning means on a frame for positioning the sheets face to face in an aligned stack in a first position with their spine edges and their outer edges opposite their spine edges aligned in generally horizontal planes at right angles to the side surfaces and their side surfaces extending generally vertically upward from the spine edges; revolving means on the frame for revolving the aligned stack of sheets from the first position to a second position at which their spine edges and their outer edges are aligned in generally vertical planes at right angles to the side surfaces and the side surfaces extend generally horizontally; and arching means on the frame and activatable with the stack of sheets initially in the second position for arching a portion of the stack of sheets between their spine and outer edges about an axis parallel to those edges while retaining the outer edges of the sheets in a plane at a right angle to adjacent side surface portions of the stack to cause relative slippage of portions of the sheets to expose the narrow side surface portions of corresponding sides of the sheets adjacent their spine edges so that the first layer of pressure sensitive adhesive may be applied thereto, and for subsequently returning the arched stack of sheets to the second position to again cause relative slippage of portions of the sheets adjacent their spine edges to again align the spine edges of the sheets in a plane generally at a right angle to the side surfaces of the sheets to re-form the first layer of pressure sensitive adhesive along the spine edges and narrow side surface portions of the sheets as described above. Also, preferably the positioning, revolving and arching means comprise firm clamping means including first and second opposed jaws for firmly releasably clamping the aligned stack of sheets together adjacent their outer edges; limited clamping means for applying a predetermined clamping force to clamp the stack of sheets together adjacent their spine edges when the stack is in the second position; means for automatically engaging the limited clamping means with the stack during revolving of the stack from the first position to the second position by the revolving means; and means for moving the firm clamping means engaged with the aligned stack to help position the stack in the first or the second positions and to arch a portion of the stack, the portions of the sheets in the stack engaged by the limited clamping means slipping relative to each other under under the limited clamping means to expose the narrow side surface portions of corresponding sides of the sheets adjacent the spine edges and to thereafter return the arched clamped stack of sheets to the second position to again align the spine edges in a plane generally at a right angle to the side surfaces of the sheets.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
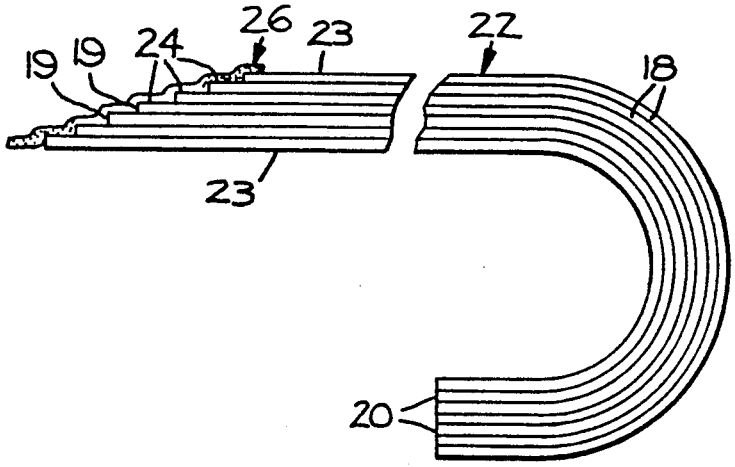
FIGS. 1 and 2 are enlarged fragmentary edge views sequentially illustrating a method of binding sheets to form a bound document included in the system according to the present invention.
Figure 2:
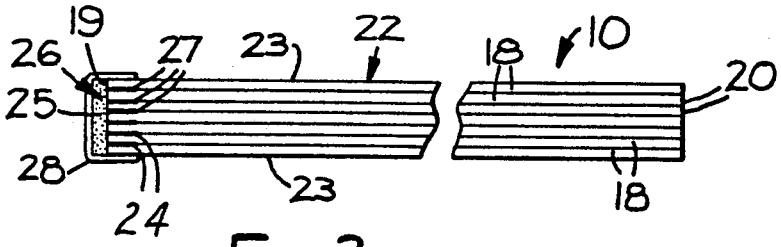
Figure 3:
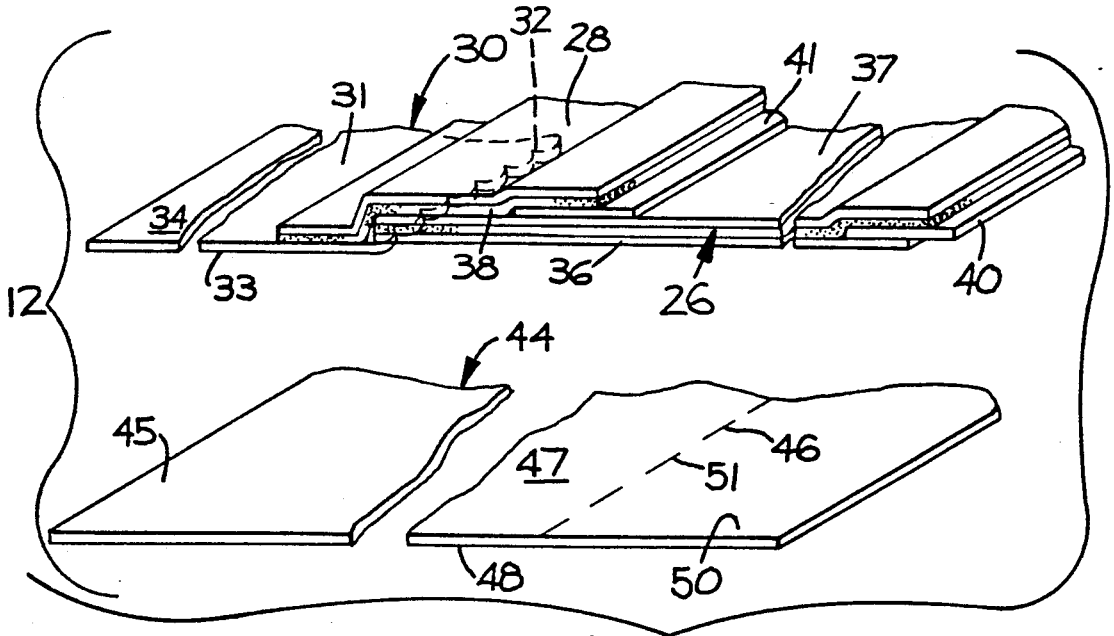
FIG. 3 is an enlarged fragmentary perspective view of a novel cover structure included in the system according to the present invention that can be used for binding sheets.
Figure 4:
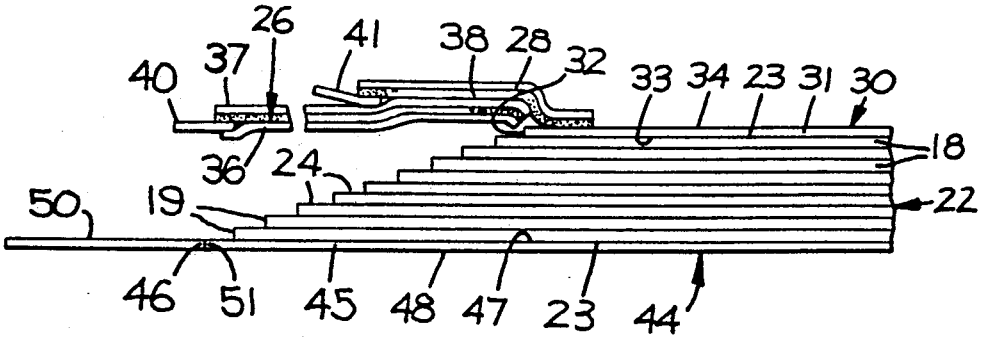
FIGS. 4, 5, 6 and 7 are enlarged fragmentary edge views sequentially schematically illustrating using the cover structure of FIG. 3 in the method of binding sheets included in the system according to the present invention.
Figure 5:
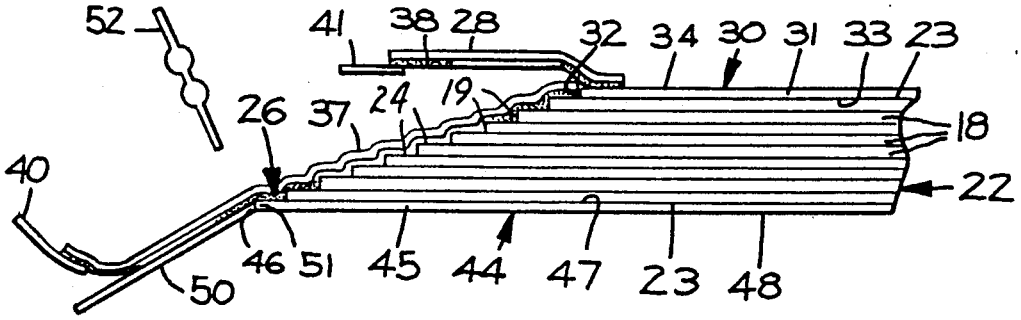
Figure 6:
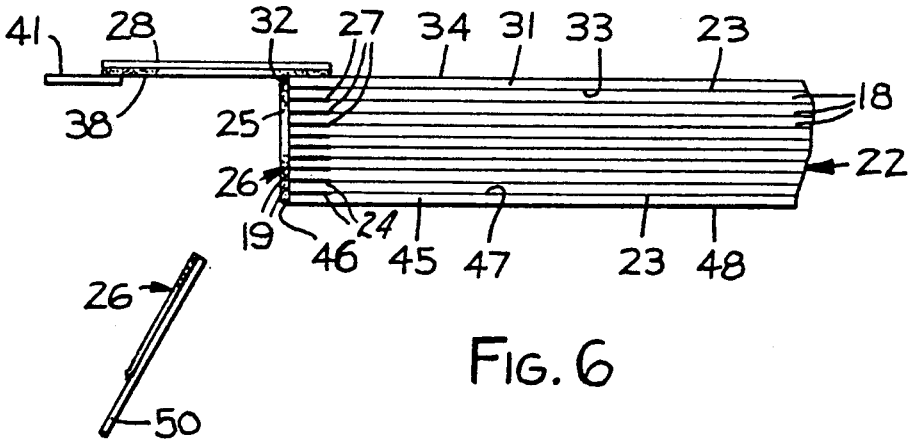
Figure 7:
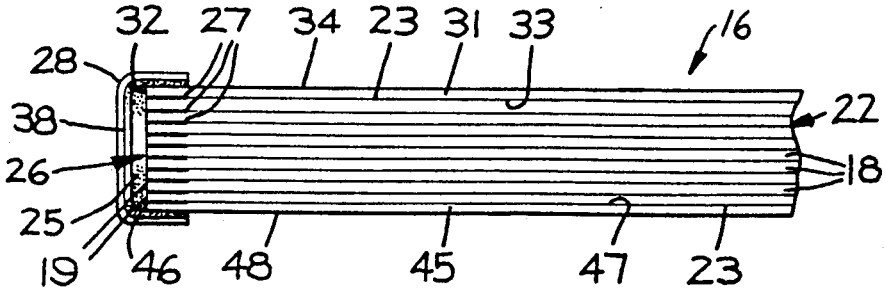

Referring now to the drawing, there is shown a system for binding sheets according to the present invention using a method illustrated schematically in FIGS. 1 and 2 to form a coverless bound document 10, which system may additionally include a cover structure 12 shown in FIG. 3 and/or a device 14 illustrated in FIGS. 8 through 19 that can be used to form the bound document 16 illustrated in FIG. 7 using the method schematically illustrated in FIGS. 4 through 7 or the method illustrated in conjunction with the device 14 in FIGS. 9A through 21.

Generally the method according to the present invention sequentially illustrated in FIGS. 1 and 2 for binding sheets 18 to form the bound document 10 (each of which sheets 18 has a spine edge 19, an outer edge 20 opposite the spine edge 19, and opposite major side surfaces) comprises the steps of disposing the sheets 18 in a stack 22 having side surfaces 23 with narrow side surface portions 24 of the sheets 18 adjacent their spine edges 19 exposed beyond the spine edges 19 of overlying sheets 18 (FIG. 1); pressing a generally uniformly thick first layer 26 of pressure sensitive adhesive over the spine edges 19 and exposed narrow side surface portions 24 (FIG. 1); moving the sheets 18 to a position with the spine edges 19 of the sheets 18 generally aligned in a plane generally at a right angle to the side surfaces 23 of the stack 22 to re-form the first layer 26 of pressure sensitive adhesive so that a major portion 25 of the re-formed first layer 26 of pressure sensitive adhesive extends in a generally uniform layer along the spine edges 19 of the sheets 18 and minor portions 27 of the re-formed first layer 26 of pressure sensitive adhesive extend between the narrow side surface portions 24 of the sheets 18 to retain adhesion of the first layer 26 of pressure sensitive adhesive to the spine edges 19 and the narrow side surface portions 24 (FIG. 2); and adhering a generally planar central portion of a strong flexible conformable backing 28 (e.g., the 0.02 centimeter or 0.008 inch thick pyroxylin coated flexible material sold under the trade designation "Pajco II" by Boise Cascade, Lowville, NY) over the major portion 25 of the re-formed first layer 26 of pressure sensitive adhesive on its side opposite the spine edges 19 and attaching end portions of the flexible backing 28 at the sides of the stack 22 to retain the spine edges 19 of the sheets 18 in a plane at generally a right angle to the side surfaces 23 of the stack 22 (FIG. 2) which could be done as illustrated in FIG. 2 by adhering the end portions of the flexible backing 28 (which could be coated with a pressure sensitive adhesive) to the end sheets 18 defining the side surfaces 23 of the stack 22 or to cover plates provided at the ends of the stack 22 which are not illustrated in FIGS. 1 and 2.

Use of the method described above to bind a document is facilitated by using the cover structure 12 illustrated in FIG. 3 which comprises a first cover assembly 30 including a first cover plate 31 of a stiff flexible material (e.g., about 0.025 to 0.064 centimeter (0.010 to 0.025 inch) thick cover stock material) having about the same major surface dimensions as the sheets 18 to be bound, having a spine edge 32, an inner surface 33 adapted to be placed adjacent one side surface 23 of the stack 22, and an outer surface 34. First and second release liners 36 and 37 (e.g., each made of 60–80 pound per ream silicone coated craft paper) project from the spine edge 32 of the first cover plate 31 with the first liner 36 along a narrow portion of its outer surface 34 adjacent its spine edge 32, the second liner 37 on the side of the first liner 36 opposite the first cover plate 31, and the first layer 26 of pressure sensitive adhesive between and releasably adhered to both of the liners 36 and 37. The flexible backing 28 has an edge portion attached (as by an adhesive) to a portion of the outer surface 34 of the first cover plate 31 adjacent its spine edge 32 and projects past its spine edge 32 along the side of the second liner 37 opposite the first liner 36. A second layer 38 of pressure sensitive adhesive is firmly adhered to the projecting portion of the flexible backing 28 adjacent the second liner 37 and is releasably adhered to the side of the second liner 37 opposite the first liner 36 to removably attach the first liner 36 and thereby the first layer 26 of pressure sensitive adhesive and second liner 37 to the first cover plate 31. A narrow third release liner 40 is adhered along an edge portion of the first layer 26 of pressure sensitive adhesive opposite the first cover plate 31 and adjacent the first liner 36, and a narrow fourth release liner 41 is adhered along an edge portion of the second layer 38 of pressure sensitive adhesive opposite the first cover plate 31, which third and fourth liners 40 and 41 both provide unattached lips that are easily manually engaged to separate the first and second layers 26 and 38 of pressure sensitive adhesive from the first and second liners 36 and 37, respectively, and then help provide means by which the outer edges of those layers 26 and 38 of pressure sensitive adhesive may be grasped to help position them during use of the first cover assembly 30 to bind sheets 18. Preferably the adjacent edge of the first layer 26 of pressure sensitive adhesive between the first and second liners 36 and 37 projects along the outer side surface 34 of the first cover plate 31 for a short distance (e.g., about 0.4 centimeter) to ensure engagement between the first layer 26 of pressure sensitive adhesive and the sheet 18 adjacent the first cover plate 31 in the stack 22 being bound, and the the spine edge 32 of the first cover plate 31 is scalloped along its length (e.g., scallops 0.1 centimeter deep peak to valley) so that the first layer 26 of pressure sensitive adhesive can contact the narrow side surface portion 24 of the sheet 18 adjacent the first cover plate 31 in the stack 22 of sheets 18 being bound.

Also included in the cover structure 12 is a second cover assembly 44 including a second cover plate 45 of a stiff flexible material (e.g., also about 0.025 to 0.064 centimeter (0.010 to 0.025 inch) thick cover stock material) having about the same major surface dimensions as the sheets 18 to be bound, having a spine edge 46, an inner surface 47 adapted to be placed adjacent a side surface 23 of the stack 22 opposite the first cover plate 31 with the spine edge 46 aligned with the spine edges of the sheets 18 in the stack 22, and a disposable plate 50. The disposable plate 50 is separably attached edge to edge to the second cover plate 45 along its spine edge 46 by being formed integrally with the second cover plate 45 and having a line of perforations 51 along and defining the spine edge 46, along which line of perforations 51 the disposable plate 50 may be torn from the second cover plate 45.

Binding the sheets 18 to form the bound document 16 using the cover structure 12 is illustrated in FIGS. 4, 5, 6 and 7. The cover plates 31 and 45 are positioned on opposite sides of the stack 22 of sheets 18 with the spine edges 32 and 46 of the cover plates 31 and 45 aligned with the spine edges 19 of the sheets during the disposing step in which the sheets 18 are disposed in a stack 22 having side surfaces 23 with narrow side surface portions 24 of the sheets 18 adjacent their spine edges 19 exposed beyond the spine edges 19 of overlying sheets 18 (FIG. 4); the first liner 36 is manually removed from the first layer 26 of pressure sensitive adhesive prior to the pressing step in which the generally uniformly thick first layer 26 of pressure sensitive adhesive is pressed over the spine edges 19 and exposed narrow side surface portions 24, and the third liner 40 and edge portion of the second liner 37 opposite the first cover plate 31 provide means for grasping the edge of the first layer 26 of pressure sensitive adhesive opposite the first cover plate 31 to position it prior to the pressing step (FIG. 5); the first layer 26 of pressure sensitive adhesive is pressed against the spine edges 19 and narrow side surface portions 24 of the sheets 18 in the stack 22 and against the disposable plate 50 of the second cover assembly 44 through the second liner 37 during the pressing step, preferably manually with the use of a flexible pressing blade 52 (FIG. 5); the second and third liners 37 and 40 are manually removed after the pressing step and prior to the moving step in which the sheets 18 are moved to a position with the spine edges 19 of the sheets 18 generally aligned in a plane generally at a right angle to the side surfaces 23 of the stack 22 so that the first layer 26 of pressure sensitive adhesive will be re-formed during the moving step to provide a major portion 25 of the re-formed first layer 26 of pressure sensitive adhesive that extends in a generally uniform layer along the spine edges 19 of the sheets 18 and minor portions 27 of the re-formed first layer 26 of pressure sensitive adhesive that extend between the narrow side surface portions 24 of the sheets 18 to retain adhesion of the first layer 26 of pressure sensitive adhesive to the spine edges 19 and the narrow side surface portions 24 (FIG. 6); the disposable plate 50 is removed from the second cover plate 45 and discarded by tearing it away along the perforations 51 after the pressing step to remove any un-needed portion of the first layer 26 of pressure sensitive adhesive extending beyond the stack 22 (FIG. 6); the fourth liner 41 together with the edge portion of the flexible backing 28 opposite the first cover plate 31 affords a grip to position the central portion of the flexible backing 28 and the attached second layer 38 of pressure sensitive adhesive along the major portion 25 of the re-formed first layer 26 of pressure sensitive adhesive after which the fourth liner 41 is removed and the edge portion of the flexible backing 28 is adhered to a portion of the second cover plate 45 adjacent its spine edge 46 during the applying step so that the flexible backing 28 thereafter retains the spine edges 19 of the sheets 18 in the stack 22 in a plane generally at a right angle to the side surfaces 23 of the stack 22 in the completed bound document 16 (FIG. 7).

Figure 8:
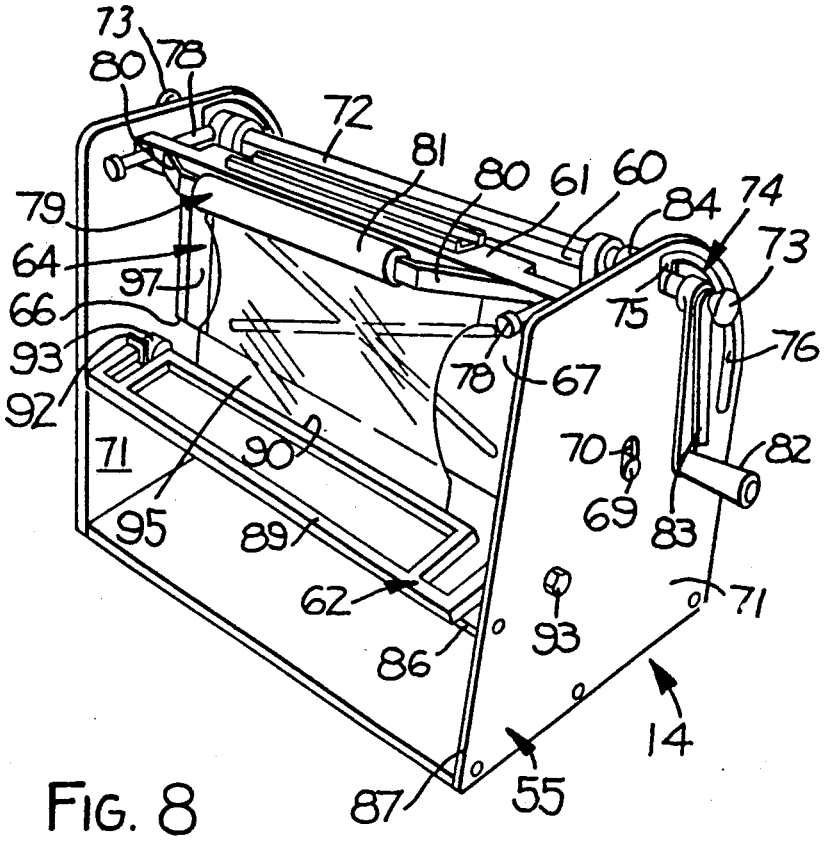
FIGS. 8, 9A, 9B, and 10 through 21 are perspective or vertical sectional views sequentially illustrating practicing the method of FIGS. 4 through 7 for binding sheets using a device and subsequent manual steps included in the system according to the present invention.

FIG. 8 illustrates the device 14, and FIGS. 9A through 21 sequentially illustrate using the device 14 and subsequent manual steps to bind sheets 18 into the bound document 16 using the cover structure 12.

Figure 9A:
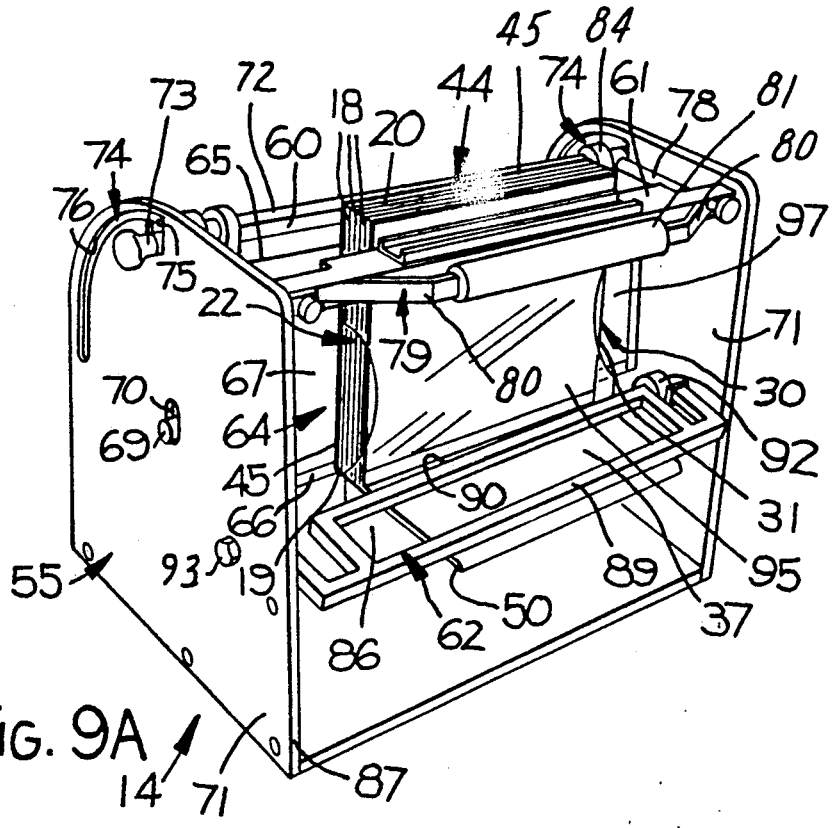
Figure 9B:
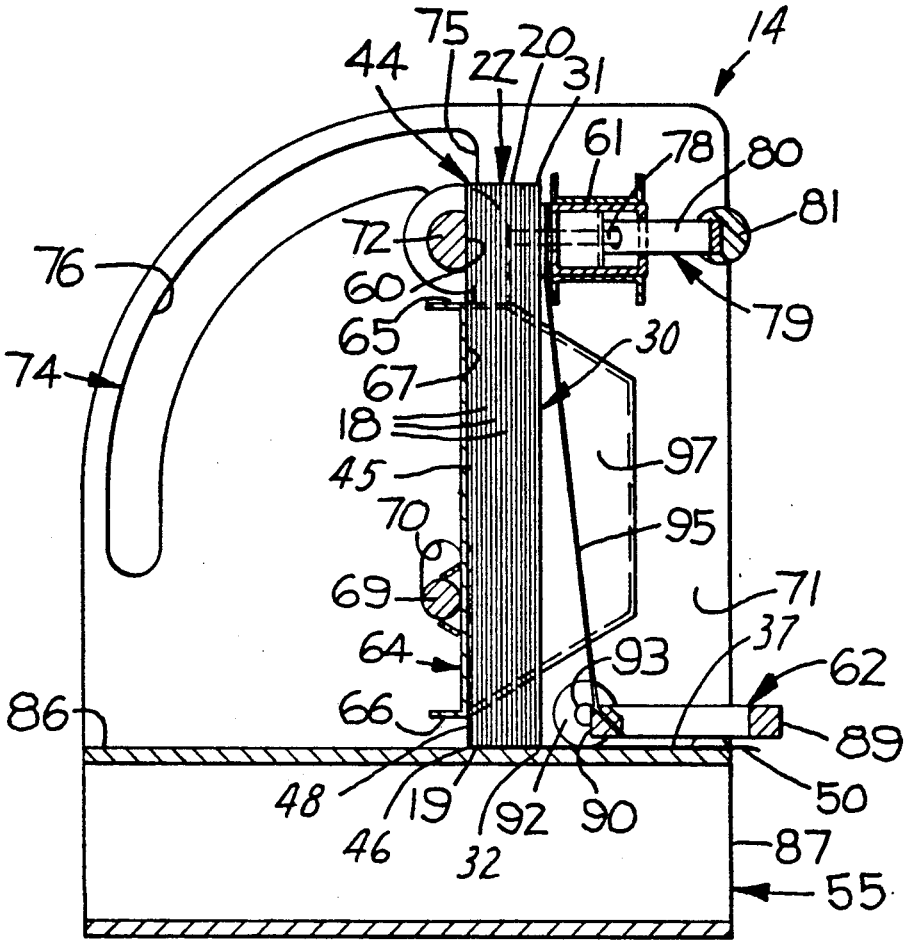
Figure 11:
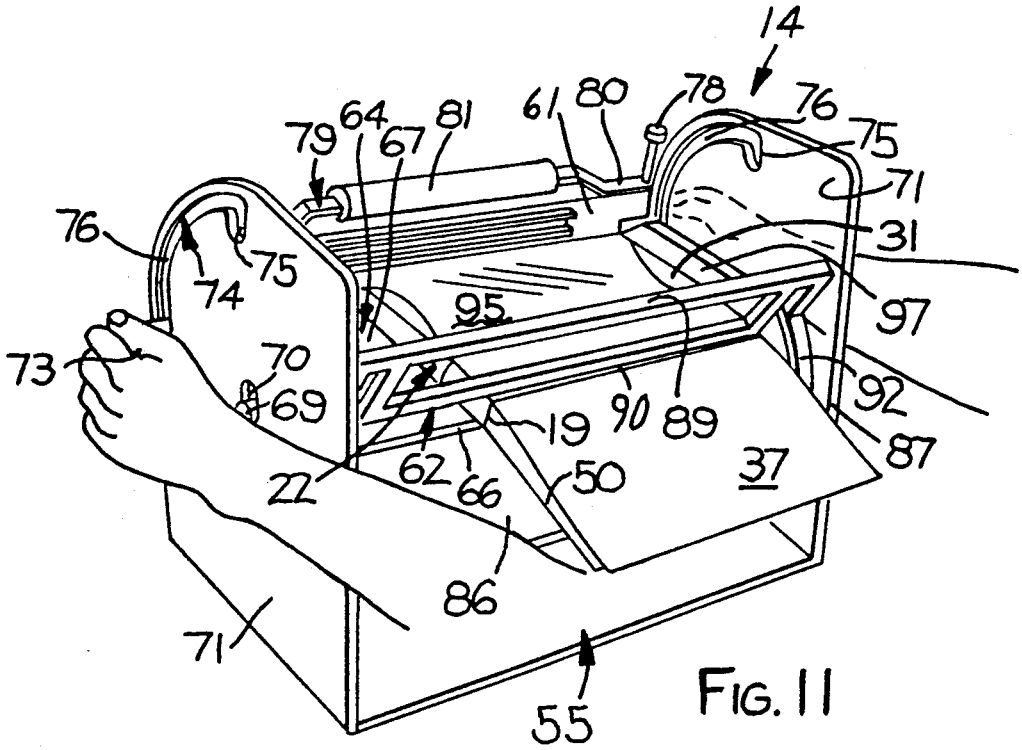
Figure 12:
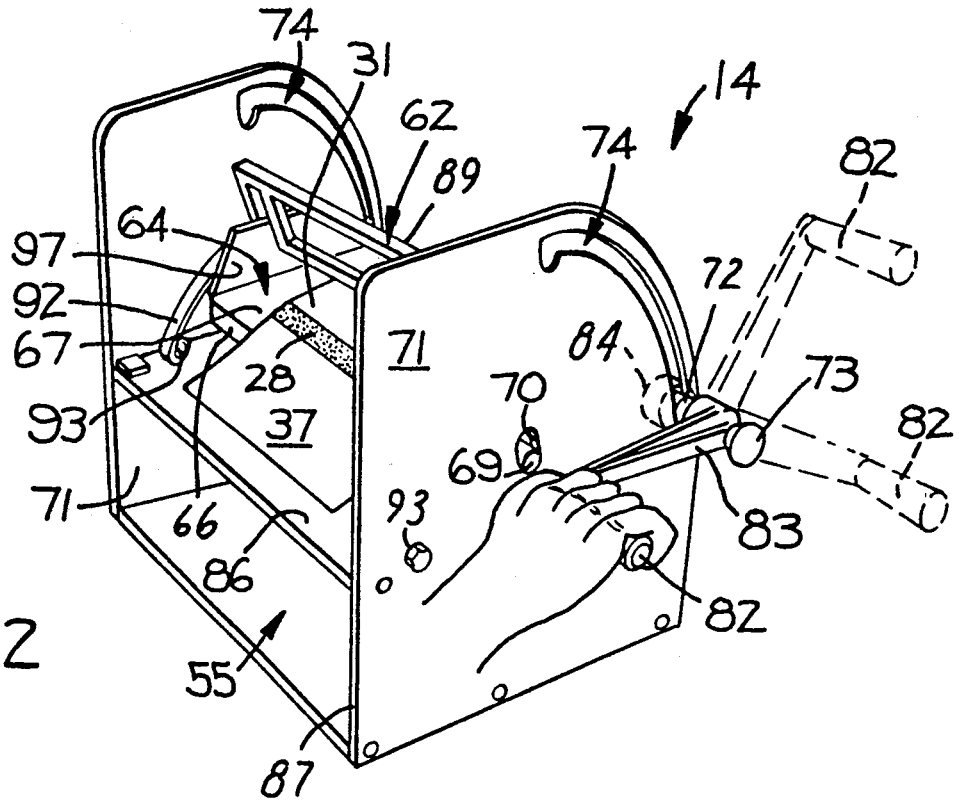
Figure 13:
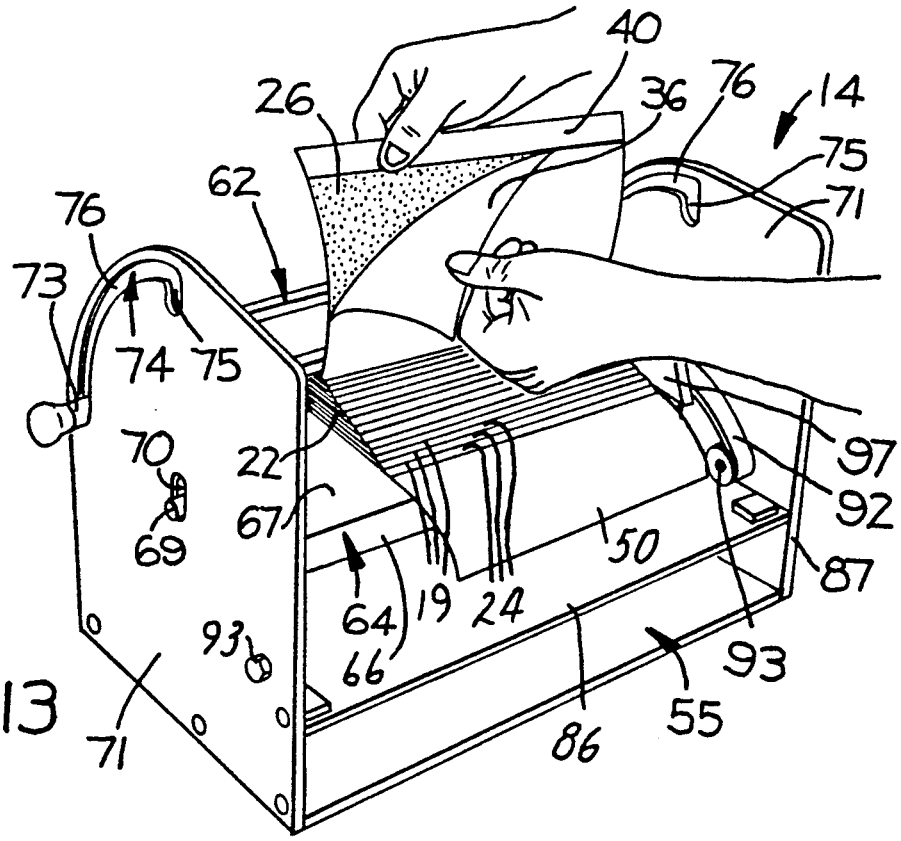
Figure 14:
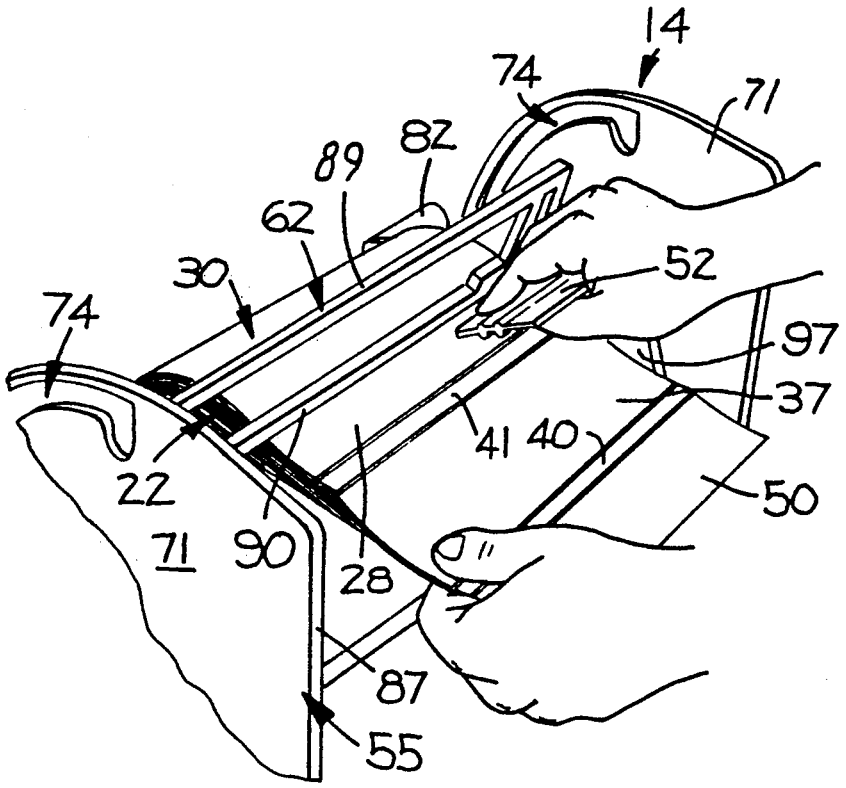
Figure 16:
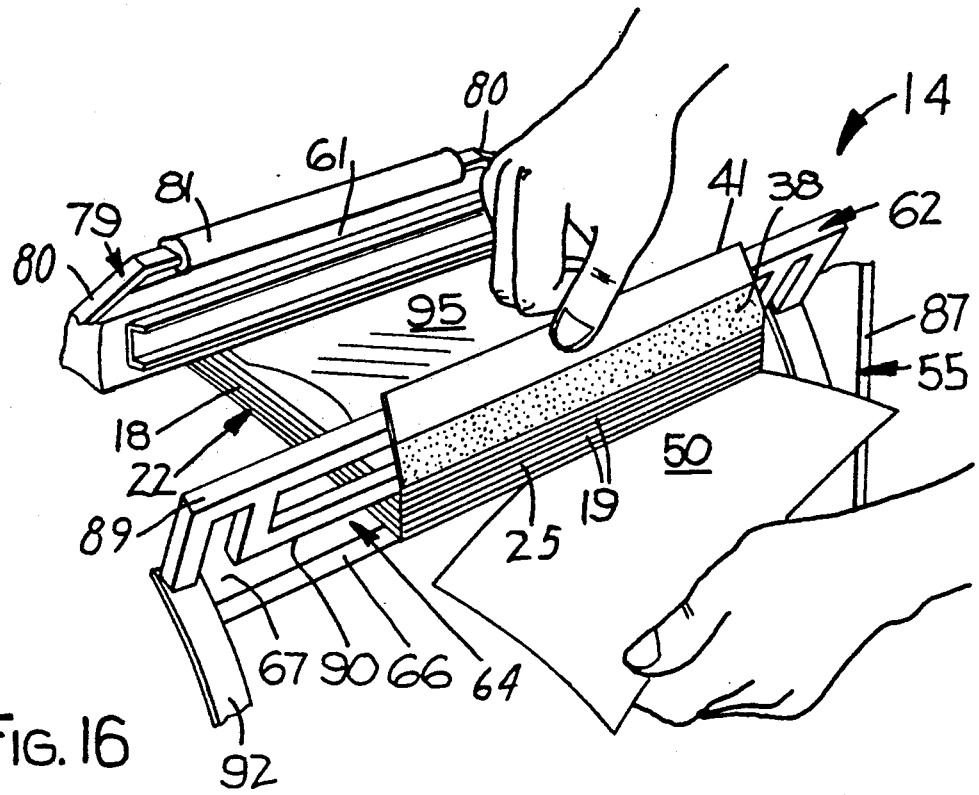
Figure 17:
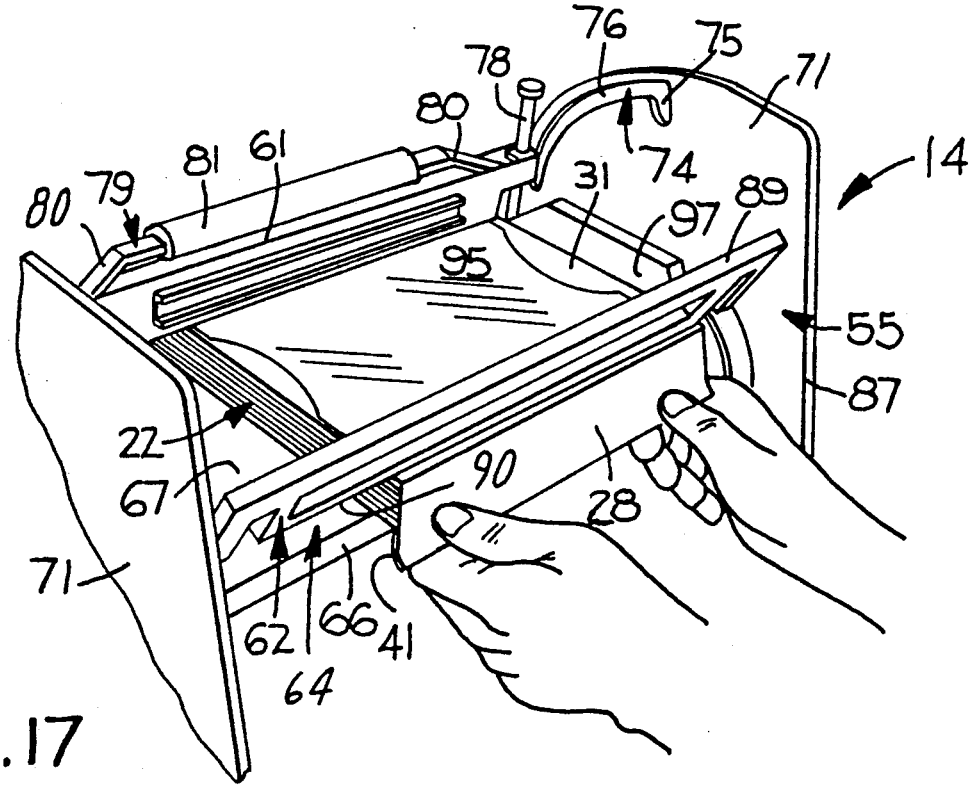
Figure 18:
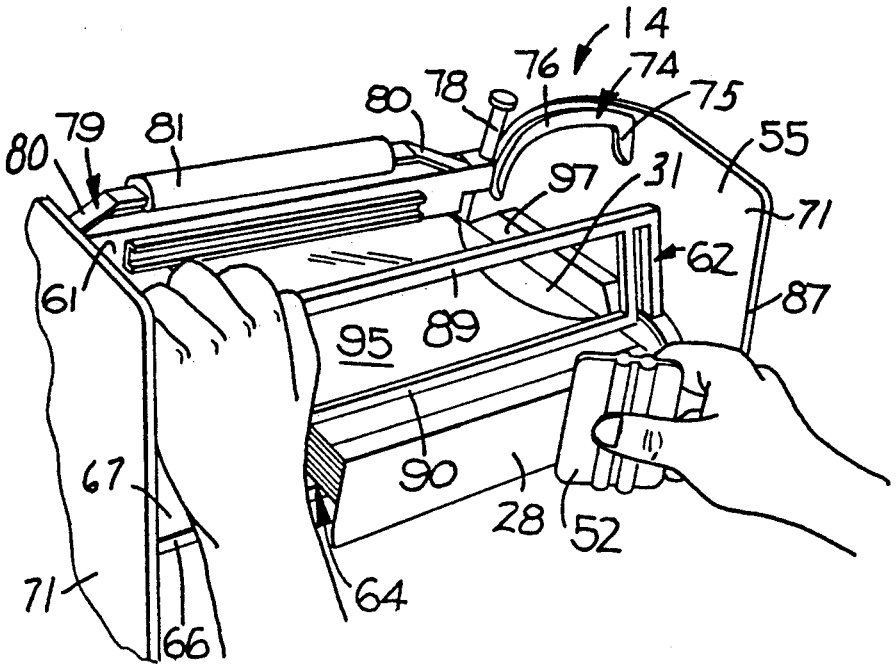
Figure 20:
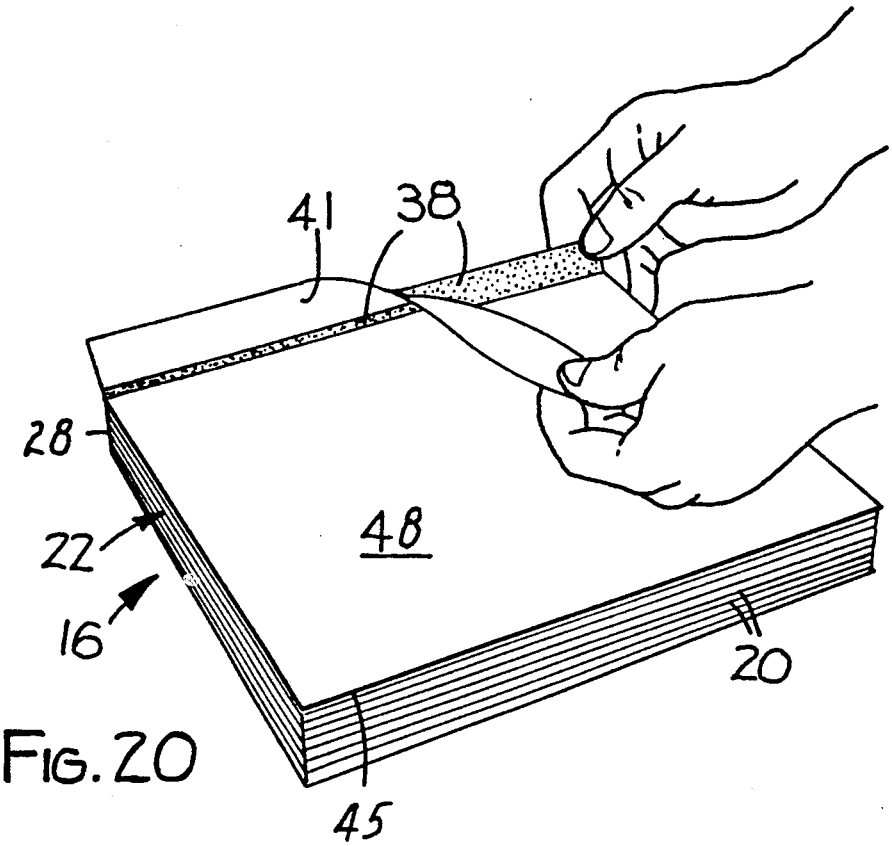
Figure 21:
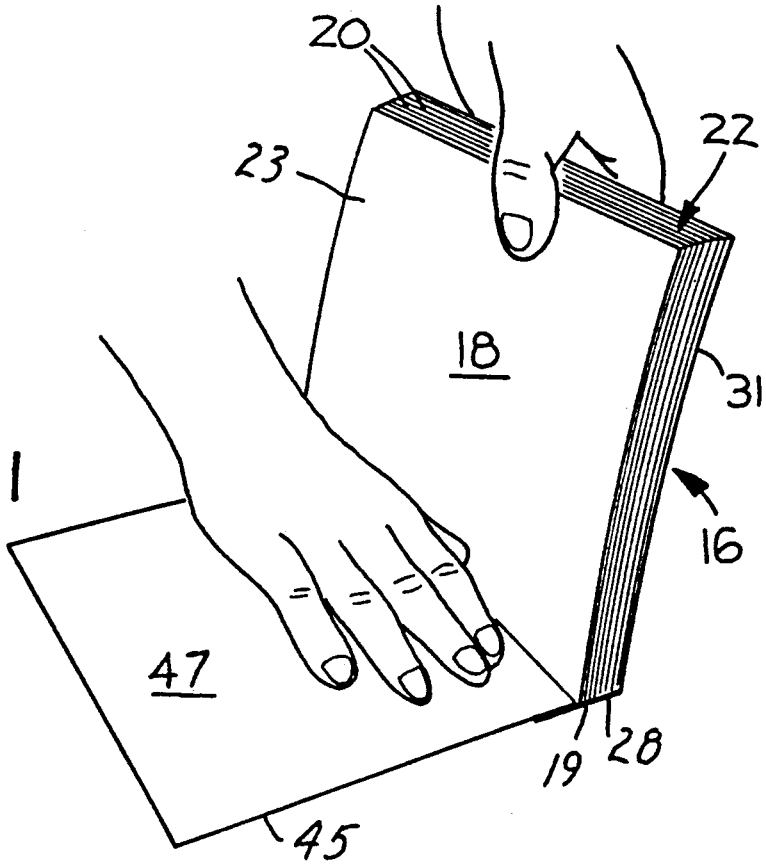

Generally, the device 14 comprises (1) positioning means on a frame 55 for, as shown in FIGS. 9A and 9B, positioning the sheets 18 face to face in an aligned stack 22 in a first position with the spine edges 19 and the outer edges 20 of the sheets 18 in the stack 22 aligned in generally horizontal planes at right angles to the side surfaces 23 of the stack and those side surfaces 23 of the stack 22 extending generally vertically upwardly from the spine edges 19, with the inner surface of the second cover plate 45 of the second cover assembly 44 positioned along one side surface 23 of the stack 22 with its spine edge 46 aligned with the spine edges 19 of the sheets 18 in the stack 22 and the disposable plate 50 extending along the spine edges 19 of the sheets 18, and the inner surface 33 of the first cover plate 31 of the first cover assembly 30 positioned along the opposite side surface 23 of the stack 22 with its spine edge 32 aligned with the spine edges 19 of the sheets 18 in the stack 22 and the composite including the liners 36 and 37, first and second layers 26 and 38 of pressure sensitive adhesive and flexible backing 28 projecting away from the stack 22 along the disposable plate 50; (2) revolving means on the frame 55 for, as shown in FIG. 11, revolving the aligned stack 22 of sheets 18 from the first position to a second position at which second position the spine edges 19 and the outer edges 20 of the sheets 18 in the stack 22 are aligned in generally vertical planes at right angles to the side surfaces 23 of the stack 22 and those side surfaces 23 extend generally horizontally, and the spine edges 19, 32 and 46 of the stack 22 and cover plates 31 and 45 are exposed; and (3) arching means on the frame 55 and activatable with the stack 22 of sheets 18 initially in the second position shown in FIG. 11 for, as shown in FIG. 12, arching a portion of the stack 22 of sheets 18 between the spine and outer edges 19 and 20 about an axis parallel to those edges 19 and 20 while retaining the outer edges 20 of the sheets 18 in a plane at a right angle to adjacent portions of the side surfaces 23 of the stack 22 to cause relative slippage of portions of the sheets 18 to expose narrow side surface portions 24 of corresponding sides of the sheets 18 adjacent their spine edges 19 as shown in FIG. 13 so that the first layer 26 of pressure sensitive adhesive may be applied thereto as shown in FIG. 14 in the manner described above, and for subsequently returning the arched stack 22 of sheets 18 to the second position to again cause relative slippage of portions of the sheets 18 adjacent their spine edges 19 to again align their spine edges 19 in a plane generally at a right angle to the side surfaces 23 of the stack 22 and re-form the first layer 26 of pressure sensitive adhesive as shown in FIG. 16 and described above, after which the disposable plate 50 may be removed along with any unneeded portions of the first layer 26 of pressure sensitive adhesive adhered thereto as shown in FIG. 16, and the flexible backing 28 may be attached first along the major portion 25 of the re-formed first layer 26 of pressure sensitive adhesive as shown in FIGS. 17 and 18, and then to the second cover plate 45 as shown in FIGS. 20 and 21 after the bound document 16 is removed from the device 14.

Also generally, the positioning, revolving and arching means in the device 14 comprise firm clamping means including first and second opposed jaws 60 and 61 for firmly clamping the aligned stack 22 of sheets 18 together adjacent their outer edges 20; limited clamping means comprising a pressure bar 62 attached to the frame 55 by spring means or springs 92 at its ends for applying a predetermined clamping force to clamp the stack 22 of sheets 18 together adjacent their spine edges 19 when the stack 22 is in the second position; means for automatically engaging the limited clamping means with the stack 22 during revolving of the stack 22 from the first position to the second position by the revolving means; and means for moving the firm clamping means engaged with the aligned stack 22 to help position the stack 22 in the first or the second positions and to arch a portion of the stack 22, with the portions of the sheets 18 in the stack 22 engaged by the limited clamping means slipping relative to each other under the limited clamping means to expose narrow side surface portions 24 of corresponding sides of the sheets 18 adjacent their spine edges 19 and to thereafter return the arched clamped stack 22 of sheets 18 to the second position to again align their spine edges 19 in a plane generally at a right angle to the side surfaces 23 of the sheets 18.

Specifically, the device 14 comprises a platen 64 having first and second ends 65 and 66 and a generally planar support surface 67 between its ends 65 and 66, and pivotal mounting means including pins 69 projecting from opposite sides of the platen 64 between its ends 65 and 66 and journaled in surfaces defining opposed vertical slots 70 in opposite side walls 71 of the frame 55 together with a horizontal rod 72 at the first end 65 of the platen 64 having opposite end portions 73 projecting through and guided by surfaces defining opposed guide slots 74 in the side walls 71 including vertical slot portions 75 aligned with the vertical slots 70, and arcuate slot portions 76, which pivotal mounting means mounts the platen 64 on the frame 55 for pivotal movement about a transverse axis defined by the pins 69 between a vertical position (FIGS. 8, 9A, 9B and 10) at which the pins 69 and the end portions 73 of the horizontal rod 72 are at the bottoms of the vertical slots 70 and the vertical slot portions 75 respectively with the support surface 67 generally vertical, and a horizontal position at which the end portions 73 of the horizontal rod 72 have been moved along the arcuate slot portions 76 to a position at their lowermost ends so that the support surface 67 is generally horizontal. The first and second jaws 60 and 61 of the firm clamping means each have an engagement surface adapted to engage the cover plates 31 and 45 and thereby the adjacent side surface 23 of the stack 22 of sheets 18, and the firm clamping means includes means in the form of two spaced parallel posts 78 projecting at a right angle from the horizontal rod 72, which posts 78 project through transverse openings in the second jaw 61 so that the second jaw 61 is transversely slidably mounted on the posts 78 for movement relative to the first jaw 60 between clamped and released positions relative to a stack 22 of sheets 18 and cover plates 31 and 45 between the jaws 60 and 61. The clamping means also includes manually operable means for releasably retaining the jaws 60 and 61 in the clamped position including a spring member 79 having end portions 80 longitudinally slidably mounted within passageways in the second jaw 61 and encircling the posts 78. The spring member 79 is normally biased to a locked position with a central portion 81 of the spring member arched away from the second jaw 61 at which locked position the end portions 80 of the spring member 79 are biased into locking engagement with the outer surfaces of the posts 78. The central portion 81 of the spring member 79 is manually movable toward the second jaw 61 to a release position at which the spring member 79 is partially straightened, thereby moving its end portions 80 away from its central portion 81 and releasing their engagement with the posts 78 so that the second jaw 61 can be manually slid along the posts 78 to move the second jaw 61 between the clamping and release positions of the clamping means. The first jaw 60 is pivotably mounted on the horizontal rod 72 at the first end 65 of the platen 64 to afford manual pivotal movement of the first and second jaws 60 and 61 by manual use of a crank 82 attached at the end of the first jaw 60 and accessible on the outer surface of one of the side walls 71 between a normal position (shown in solid lines in FIG. 12) with the engagement surface of the first jaw 60 generally aligned with the support surface 67 of the platen 64, and first and second arching positions (shown in dotted outline in FIG. 12) with the engagement surface of the first jaw 60 oriented at various angles with respect to the support surface 67; the first of which arched positions orients the engagement surface of the first jaw 60 at an angle of about 115 degrees with respect to the support surface and is used for arching stacks of fan folded paper to be bound, and the second of which arched positions orients the engagement surface of the first jaw 60 at an angle of about 225 degrees with respect to the support surface 67 and is used for arching stacks 22 of individual sheets 18 of paper to be bound. A release lever 83 carried on the crank 82 has a stop (not shown) movable along a relieved area of a ring 84 fixed on the horizontal rod 72 between recesses in the ring 84 into which the stop is biased by a spring (not shown) between the lever 83 and crank 82, which recesses can position the crank 82 with the first jaw 60 at its normal position, at the first arching position, or at the second arching position. The frame 55 includes a paper locating wall 86 having a generally horizontal alignment surface located adjacent the second end 66 of the platen 64 when the platen 64 is in the vertical position, which locating wall 86 extends between the side walls 71 toward an open front side 87 of the frame 55. The pressure bar 62 which has a rectangular cross section extends between the side walls 71, has an elongate pressure surface 90 between its ends adjacent the side walls 71, and has a transverse opening through its center that provides a manually engageable handle portion 89 of the bar 62 on its side opposite the pressure surface. Two constant tension coiled "Negator" type springs 92 have ends attached to projections at the ends of the bar 62 and are rotatably mounted at attachment positions 93 on the side walls 71 of the frame 55, which attachment positions 93 are spaced along the alignment surface of the locating wall 86 from the second end 66 of the platen 64 when the platen 64 is in its vertical position, and are positioned slightly above the locating wall 86. The springs 92 bias the pressure surface 90 toward the attachment positions 93 while affording movement of the bar 62 away from the attachment positions 93 in various directions in opposition to the constant biasing of the springs 92 including at a right angle to the support surface 67 when the platen 64 is in its first position and at a right angle to the alignment surface of the locating wall 86, and at various angles therebetween. A flexible polymeric sheet 95 has one end attached along the pressure surface 90 of the pressure bar 62 and an opposite end attached along the engagement surface of the second jaw 61, and has a length between the pressure surface 90 and jaw 61 that is sufficiently shorter than the distance between the spine and outer edges 19 and 20 of sheets 18 that the device 14 is adapted to bind so that the flexible sheet 95 and the springs 92 normally position the pressure surface 90 of the bar 62 a short distance above the locating wall 86 with the weight of the bar 62 biasing it to a position with its major side surface generally horizontal and the pressure surface 90 parallel and opposed to the support surface 67 when the platen 64 is in the vertical position.

The first and second jaws 60 and 61 in their released and normal positions, the flexible sheet 95, the alignment surface on the locating wall 86, the support surface 67 when the platen 64 is in its vertical position, and one of two edge walls 97 on the platen 64 against which ends of the sheets may be aligned provide the positioning means on the frame 55 for positioning the sheets 18 face to face in an aligned stack 22 in the first position with their spine edges 19 and their outer edges 20 aligned in generally horizontal planes at right angles to the side surfaces 23 of the stack 22 and those side surfaces 23 of the stack 22 extending generally vertically upwardly from the spine edges 19, with the inner surface 47 of the second cover plate 45 of the second cover assembly 44 positioned along one side surface 23 of the stack 22 with its spine edge 46 aligned with the spine edges 19 of the sheets 18 in the stack 22 and the disposable plate 50 extending along the spine edges 19 of the sheets 18, and the inner surface 33 of the first cover plate 31 of the first cover assembly 30 positioned along the opposite side surface 23 of the stack 22 with its spine edge 32 aligned with the spine edges 19 of the sheets 18 in the stack 22 and the composite including the liners 36 and 37, the first and second layers 26 and 38 of pressure sensitive adhesive and the flexible backing 28 projecting away from the stack 22 along the disposable plate 50.

Pivoting of the platen 64 from its vertical to its horizontal position with the first and second jaws 60 and 61 in their clamped and normal positions by manually grasping the end portions 73 of the horizontal rod 72, lifting the horizontal rod 72 and thereby the pins 69 upwardly in the slot portions 75 and slots 70 respectively and moving the rod end portions 73 along the arcuate slot portions 76 to their lowermost ends provides the revolving means on the frame 55 for revolving the aligned stack 22 of sheets 18 from the first position to the second position at which the spine edges 19 and the outer edges 20 of the sheets 18 in the stack 22 are aligned in generally vertical planes at right angles to the side surfaces 23 of the stack 22 with those side surfaces 23 extend generally horizontally, and the spine edges 19, 32 and 46 of the stack 22 and cover plates 31 and 45 exposed at the open front side 87 of the frame 55.

Pivoting of the first and second jaws 60 and 61 from their normal to one of their arching positions when the platen 64 is in its horizontal position and the jaws 60 and 61 are in their clamped position provides the arching means on the frame 55 which is activatable with the stack 22 of sheets 18 initially in the second position for arching a portion of the stack 22 of sheets 18 between the spine and outer edges 19 and 20 about an axis parallel to those edges 19 and 20 while retaining those outer edges 20 in a plane at a right angle to adjacent portions of the side surfaces 23 to cause relative slippage of portions of the sheets 18 adjacent their spine edges 19 and expose narrow side surface portions 24 of corresponding sides of the sheets 18 adjacent their spine edges 19 so that the first layer 26 of pressure sensitive adhesive may be applied thereto through the open front side 87 of the frame 55 in the manner described above, and for subsequently returning the arched stack 22 of sheets 18 to the second position to again cause relative slippage of portions of the sheets 18 adjacent their spine edges 19 to again align their spine edges 19 in a plane generally at a right angle to the side surfaces 23 of the stack 22 and re-form the first layer 26 of pressure sensitive adhesive as described above, after which the flexible backing 28 may be attached first along the major portion 25 of the re-formed first layer 26 of pressure sensitive adhesive, and then to the second cover plate 45 after the bound document 16 is removed from the device 14.

The bar 62, the springs 92 biasing the pressure surface 90 on the bar 62 toward the attachment positions 93, and the flexible sheet 95 attached between the bar 62 and the second jaw 61 provide the means for automatically engaging the limited clamping means with the stack 22 during revolving of the stack 22 from the first position to the second position by the revolving means, whereupon the bar 62 and the springs 92 biasing the pressure surface 90 on the bar 62 toward the attachment positions 93 provide the limited clamping means for applying a predetermined clamping force to clamp the stack 22 of sheets 18 and cover plates 31 and 45 together adjacent their spine edges 19, 32 and 46 when the stack 22 is in the second position and to afford relative slipping of the portions of the sheets 18 in the stack 22 engaged by the limited clamping means during operation of the arching means to expose narrow side surface portions 24 of corresponding sides of the sheets 18 adjacent their spine edges 19 and to thereafter return the arched clamped stack 22 of sheets 18 to the second position to again align the spine edges 19, 32 and 46 in a plane generally at a right angle to the side surfaces 23 of the stack 22.

Operation

The operation of the device 14 and subsequent manual steps used to bind sheets 18 using the cover structure 12 is sequentially illustrated in FIGS. 9A through 21.

The device 14 is initially adjusted so that as shown in FIG. 8, the platen 64 is in its first position with the support surface 67 vertical, and the jaws 60 and 61 of the clamping means are spaced sufficiently to afford positioning the sheets 18 to be bound and the cover plates 31 and 45 of the cover structure 12 therebetween.

Figure 10:
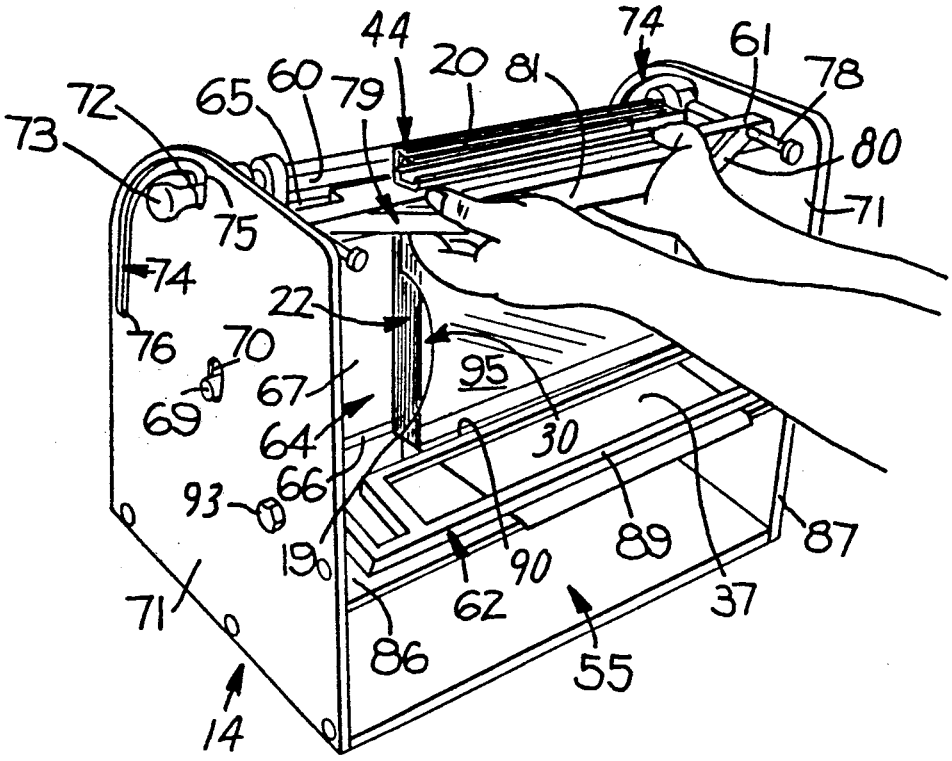

The second cover assembly 44 is then positioned with the outer surface 48 of the second cover plate 45 against the first jaw 60 and support surface 67, its spine edge 46 against the alignment surface on the locating wall 86, and the disposable plate 50 projecting along that alignment surface toward the open front side 87 of the frame 55; the sheets 18 are then positioned along the inner surface 47 side of the second cover plate 45 with their spine edges 19 against the disposable plate 50; and the first cover assembly 30 is then positioned with the inner surface 33 of the first cover plate 31 along the side of the sheets 18 opposite the second cover plate 45 and its spine edge 32 against the disposable plate 50 and the composite including the liners 36 and 37, the first and second layers 26 and 38 of pressure sensitive adhesive and the flexible backing 28 projecting along the disposable plate 50 toward the open front side 87 of the frame 55 under the pressure bar 62 as is shown in FIGS. 9A and 9B. The sheets 18 and cover plates 31 and 45 are then jogged to position their sides against one edge wall 97 of the platen 64 and insure that they are all down as far as possible against the locating wall 86, and the second jaw 61 is moved toward the first jaw 60 by manually pressing the central portion 81 of the spring member 79 toward the second jaw 61 to forcefully clamp the sheets 18 and cover plates 31 and 45 together adjacent the outer edges 20 of the sheets 18 as is shown in FIG. 10, whereupon the central portion 81 is released so that the spring member 79 again engages the posts 78 to retain the jaws 60 and 61 in their engaged position.

The platen 64 is then manually moved to its second position as is illustrated in FIG. 11 by manually grasping the end portions 73 of the horizontal rod 72, lifting them from the vertical portions 75 of the guide slots 74, and moving them along the arcuate portions 76 of the guide slots 74 to their lowermost end so that the platen 64 moves to its second position with its support surface 67 and the side surface 23 of the stack 22 of sheets 18 thereon horizontal. During such movement, the pressure surface 90 of the the pressure bar 62 engages the outer surface 34 of the first cover plate 31 adjacent its spine edge 32 and then under the influence of the constant force springs 92 applies a limited pressure to press together the cover plates 31 and 45 and sheets 18 adjacent their spine edges 32, 46 and 19.

As shown in FIG. 12, the crank 82 is then rotated (after depressing and then releasing the lever 83) to the desired arched position determined by engagement of the stop on the lever 83 with the appropriate recess in the ring 84 to cause the jaws 60 and 61 clamped on the stack 22 and cover plates 31 and 45 to rotate on the rod 72 and arch a portion of the stack 22 of sheets 18 between their spine and outer edges 19 and 20 while the jaws 61 and 62 retain their outer edges 20 in a plane at a right angle to adjacent portions of the side surfaces 23 to cause relative slippage of portions of the sheets 18 adjacent their spine edges 19 under the pressure bar 62 and expose narrow side surface portions 24 of corresponding sides of the sheets 18 adjacent their spine edges 19 as can be seen in FIG. 13.

The first liner 36 is then manually removed from the first layer 26 of pressure sensitive adhesive as is illustrated in FIG. 13, opposite portions of the third liner 40 and second liner 37 are grasped to pull the first layer 26 of pressure sensitive adhesive on the second liner 37 into smooth engagement with the narrow side surface portions 24 and spine edges 19 of the sheets 18 and the disposable plate 50, whereupon that engagement is completed through the manual use of the flexible pressing blade 52 as is illustrated in FIG. 14.

Figure 15:
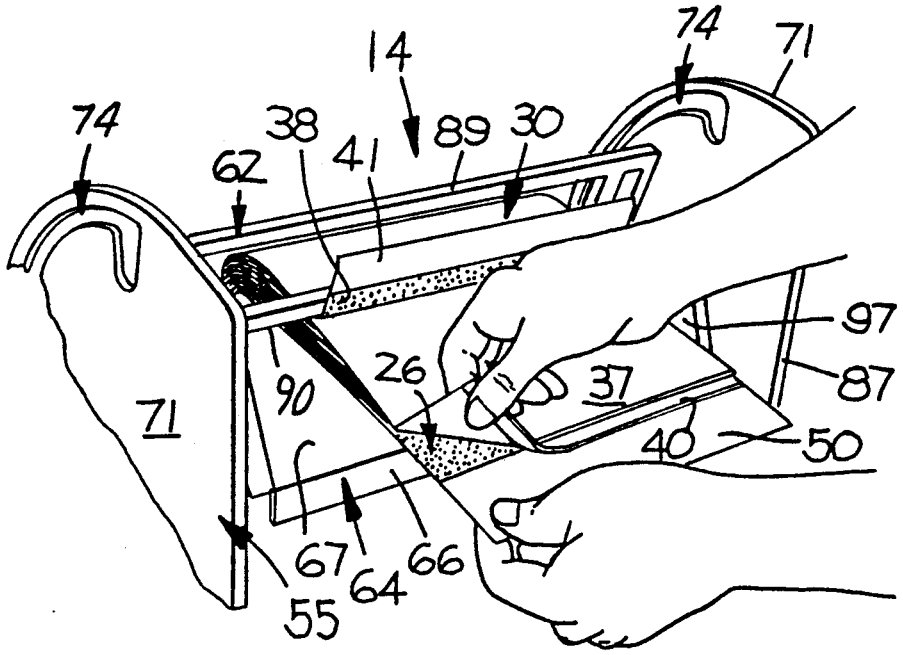

As is illustrated in FIG. 15, the flexible backing 28 with the firmly adhered second layer 38 of pressure sensitive adhesive is then peeled away and lifted from the second liner 37, and the second and third liners 37 and 40 are peeled from the first layer 26 of pressure sensitive adhesive now adhered to the sheets 18 and discarded. The crank 82 then is moved back to its normal position after depressing the lever 83 to return the arched stack 22 of sheets 18 to the second position and again cause relative slippage of portions of the sheets 18 adjacent their spine edges 19 under the pressure bar 62 to again align their spine edges 19 in a plane generally at a right angle to the side surfaces 23 of the stack 22 as is illustrated in FIG. 16 and re-form the first layer 26 of pressure sensitive adhesive to provide the major portion 25 along the spine edges 19 of the sheets 18. The disposable plate 50 is then manually torn away along the perforations 51 at the spine edge 46 of the second cover plate 45 as is illustrated in FIG. 16 to remove that portion of the first layer 26 of pressure sensitive adhesive adhered thereto that is not needed, and as illustrated in FIG. 17, opposite portions of the fourth liner 41 and the flexible backing 28 are grasped to pull the second layer 38 of pressure sensitive adhesive on the flexible backing 28 into smooth engagement with the major portion 25 of the first layer 26 of pressure sensitive adhesive along the spine edges 19 of the sheets 18, whereupon that engagement is completed as illustrated in FIG. 18 through the manual use of the flexible pressing blade 52.

Figure 19:
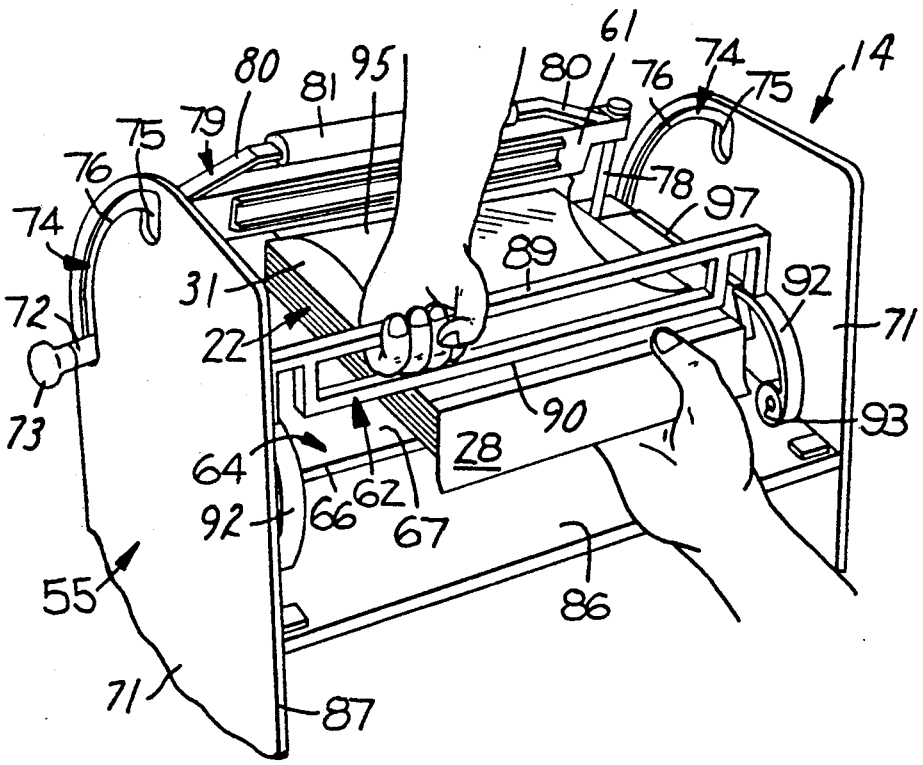

The second jaw 61 is then moved to the release position by manipulation of the central portion 81 of the spring member 79, the pressure bar 62 is manually lifted away from the document 16 by grasping it along its handle portion 89 as is illustrated in FIG. 19, and the document 16 is pulled from the device 14. As is illustrated in FIG. 20, the fourth liner 41 is then removed from the edge portion of the second layer 38 of pressure sensitive adhesive on the edge portion of the flexible backing 28 which is preferably brought into engagement with the outer surface 48 on the second cover plate 45 adjacent its spine edge 46 as is illustrated in FIG. 21 by pressing the portion of the flexible backing 28 along the spine edges 19 of the sheets 18 against a planar support surface with the edge portions of the flexible backing 28 and second layer 38 of pressure sensitive adhesive also extending along that planar support surface, moving the second cover plate 45 to a position at a right angle with respect to the sheets 18, and pressing the inner surface 47 of the second cover plate 45 along its spine edge 46 against the edge portion of the second layer 38 of pressure sensitive adhesive on the flexible backing 28 beneath it. The bound document 16 is then completed.

The system according to the present invention has now been described. It will be apparent to those skilled in the art that many changes can be made in the system and portions thereof described without departing from the scope of the present invention. Thus the scope of the present invention should not be limited to the methods and structures descried in this application, but only by methods or structures described by the language of the claims and the equivalents of those methods and structures.

We claim:

1. A method for binding a stack of sheets each having a spine edge, and an outer edge opposite the spine edge, said method comprising the steps of:

providing a first cover assembly including a first cover plate having a spine edge, an inner surface adapted to be placed adjacent one side surface of the stack, and an outer surface, first and second liners projecting from the spine edge of the first cover plate, a generally uniformly thick first layer of pressure sensitive adhesive between and releasably adhered to both of said liners, a flexible backing having an edge portion attached to a portion of the outer surface of the first cover plate adjacent the spine edge of the first cover plate and projecting past the spine edge of the first cover plate along the side of the second liner opposite the first liner, and a second layer of pressure sensitive adhesive firmly adhered to the projecting portion of the backing and releasably adhered to the second release liner;

providing a second cover assembly including a second cover plate having a spine edge, an inner surface adapted to be placed adjacent a side surface of the stack opposite the first cover plate with the spine edge of the second cover plate aligned with the spine edge of the sheets in the stack, and a disposable plate, the disposable plate being separately attached edge to edge to the spine edge of the second cover plate;

disposing the sheets in a stack having side surfaces with narrow side surface portions of the sheets adjacent the spine edges exposed beyond the spine edges of overlying sheets;

positioning the cover plates on opposite side surfaces of the stack with the spine edges of the cover plates aligned with the spine edges of the sheets during said disposing step and the inner surfaces of the cover plates adjacent opposite side surfaces of the stack;

removing the first liner from the first cover assembly;

pressing the first layer of the pressure sensitive adhesive against the spine edges and the narrow side surface portions of the sheets in the stack and against the disposable plate of the second cover assembly through the second liner after said step of removing the first liner;

removing the second liner after said pressing step;

moving the sheets to a position with the spine edges of the sheets generally aligned in a plane generally at a right angle to the side surfaces of the stack after said step of removing the second liner to re-form the first layer of pressure sensitive adhesive so that a major portion of the re-formed first layer of pressure sensitive adhesive extends in a generally uniform continuous layer along the spine edges of the sheets and minor portions of the re-formed first layer of pressure sensitive adhesive extend between the narrow side surface portions of the sheets to retain adhesion of the re-formed first layer of pressure sensitive adhesive to the spine edges and the narrow side surface portions;

removing the disposable plate from the second cover plate after said pressing step to remove any portion of the first layer of pressure sensitive adhesive extending beyond the stack; and adhering a generally planar central portion of the backing over and to the major portion of the re-formed first layer of pressure sensitive adhesive on its side opposite the spine edges; and adhering an edge portion of the backing to a portion of the second cover plate sheet adjacent its spine edge.

2. A cover structure adapted for use to bind a multiplicity of similarly sized sheets each having a spine edge, and an outer edge opposite said spine edge, which sheets are disposed in a stack having opposite side surfaces, said cover structure comprising:

a first cover assembly including a first cover plate having a spine edge, an inner surface adapted to be placed adjacent one side surface of the stack, and an outer surface, first and second liners projecting from the spine edge of said first cover plate, a first layer of pressure sensitive adhesive between and releasably adhered to both of said liners, a strong flexible backing adhered to a portion of the outer surface of said first cover plate adjacent its spine edge and projecting past the spine edge of said first cover along the side of said second liner opposite said first liner, and a second layer of pressure sensitive adhesive firmly adhered to the projecting portion of said backing and releasably adhered to said second release liner; and a second cover assembly including a second cover plate having a spine edge, an inner surface adapted to be placed adjacent the side surface of the stack opposite said first cover plate with the spine edge of said second cover plate aligned with the spine edges of sheets in the stack, and a disposable plate, said disposable plate being separably attached edge to edge to said second cover plate along the spine edge of the second cover plate so that with said cover plates positioned on opposite sides of the stack and the sheets in the stack disposed with narrow side surface portions of the sheets along the spine edges of the sheets exposed, said first liner may be removed, said first layer of pressure sensitive adhesive applied to the spine edges and narrow side surface portions of the sheets and to said disposable plate of said second cover assembly, said second liner can be removed, said disposable plate can be removed to remove any portion of said first layer of pressure sensitive adhesive extending beyond the stack, the sheets in the stack can be moved relative to each other to a position with the spine edges of the sheets in the stack positioned in a plane at a right angle with respect to the side surfaces of the stack to form said first layer of pressure sensitive adhesive so that it has a major portion extending in a generally uniform layer along the spine edges of the sheets and has minor portions extending between the narrow side surface portions of the sheets to retain adhesion of said first layer of pressure sensitive adhesive to the spine edges and the narrow side surface portions of the sheets, and said second layer of pressure sensitive adhesive on said backing can be adhered to said major portion of the first layer of pressure sensitive adhesive over the spine edges of the sheets and to a portion of said second cover plate adjacent its spine edge to retain the spine edges of the sheets in the stack in a plane generally at a right angle to the side surfaces of the stack.

3. A cover structure according to claim 2 wherein the spine edge of said first cover plate is scalloped along its length.

4. A method for binding a stack of sheets each having a spine edge, and an outer edge opposite the spine edge, said method comprising the steps of:

disposing the sheets in a stack having side surfaces with narrow side surface portions of the sheets adjacent the spine edges exposed beyond the spine edges of overlying sheets;

providing a generally uniformly thick first layer of pressure sensitive adhesive releasably adhered to a liner;

pressing the first layer of pressure sensitive adhesive against the spine edges and the exposed narrow side surface portions of the sheets in the stack through the liner;

removing the liner from the first layer of pressure sensitive adhesive after said pressing step;

moving the sheets to a position with the spine edges of the sheets generally aligned in a plane generally at a right angle to the side surfaces of the stack after said removing step to re-form the first layer of pressure sensitive adhesive so that a major portion of the re-formed first layer of pressure sensitive adhesive extends in a generally uniform continuous layer along the spine edges of the sheets and minor portions of the re-formed first layer of pressure sensitive adhesive extend between the narrow side surface portions of the sheets to retain adhesion of the re-formed first layer of pressure sensitive adhesive to the spine edges and the narrow side surface portions; and adhering a generally planar central portion of a backing over and to the major portion of the re-formed first layer of pressure sensitive adhesive on its side opposite the spine edges and attaching end portions of the backing at the sides of the stack to retain the spine edges of the sheets in a plane at generally a right angle to the side surfaces of the stack.

5. A method according to claim 4 wherein said sheets are joined at their edges to sheets adjacent their major surfaces in the stack in the manner of a fan fold with the spine edges of each sheet other than the outermost sheets in the stack joined to the spine edge of the sheet along one of its side surfaces, and the outer edge of the sheet joined to the outer edge of the sheet along the other of its side surfaces, and during said disposing step said sheets are disposed so that the narrow side surface portions have a width dimension that is at least three times the thickness dimension of one of said sheets.

6. A method according to claim 4 wherein said sheets are entirely separate from each other with each of said sheets having one of said narrow side surface portion to which said first layer of adhesive is adhered, and during said disposing step said sheets are disposed so that said narrow side surface portions have a width dimension in a directions at right angles to said spine edges that is at least three times the thickness dimension of one of said sheets.

7. A device for use in binding a multiplicity of sheets each having a spine edge, an outer edge opposite said spine edge, and major side surfaces, said device comprising:

a frame;

positioning means on said frame for positioning the sheets in an aligned stack in a first position with the spine edges and the outer edges of the sheets aligned in generally horizontal planes at right angles to the side surfaces of the sheets and the side surfaces of the sheets extending generally vertically upward from the spine edges of the sheets;

revolving means on said frame for revolving the aligned stack of sheets from said first position to a second position at which second position the spine edges and the outer edges of the sheets are aligned in generally vertical planes at right angles to the side surfaces of the sheets and the side surfaces of the sheets extend generally horizontally; and arching means on said frame and activatable with the stack of sheets initially in said second position for arching a portion of the stack of sheets between the spine and outer edges of the sheets about an axis parallel to the spine and outer edges of the sheets while retaining the outer edges of the sheets in a plane at a right angle to adjacent portions of the side surfaces of the sheets to cause relative slippage of potions of the sheets adjacent the spine edges of the sheets and expose narrow side surface portions of corresponding sides of the sheets adjacent the spine edges of the sheets so that a layer of pressure sensitive adhesive may be applied thereto, and for subsequently returning the arched stack of sheets to said second position to again cause relative slippage of portions of the sheets adjacent the spine edges of the sheets to again align the spine edges of the sheets in a plane generally at a right angle to the side surfaces of the sheets;

said positioning, revolving and arching means comprising:

firm clamping means including first and second opposed jaws for firmly clamping the aligned stack of sheets together adjacent the outer edges of the sheets;

limited clamping means for applying a predetermined clamping force to clamp the stack of sheets together adjacent the spine edges of the sheets when said stack is in said second position;

means for automatically engaging said limited clamping means with the stack during revolving of the stack from said first position to said second position by said revolving means; and means for moving said firm clamping means engaged with the aligned stack to help position the stack in said first or said second positions and to arch a portion of the stack, the portions of the sheets in the stack engaged by said limited clamping means slipping relative to each other under said limited clamping means to expose narrow side surface portions of corresponding sides of the sheets adjacent the spine edges of the sheets and to thereafter return the arched clamped stack of sheets to said second position to again align the spine edges in a plane generally at a right angle to the side surfaces of the sheets.

8. A device according to claim 7 wherein:

said device comprises a platen having first and second ends and a generally planar support surface between said ends, and means mounting said platen on said fame for pivotal movement about an transverse axis between said ends between a vertical position with said support surface generally vertical, and a horizontal position with said support surface generally horizontal;

said first and second jaws of said firm clamping means each have an engagement surface adapted to engage the stack of sheets, said firm clamping means includes means mounting said second jaw for movement relative to said first jaw between clamped and released positions relative to a stack of sheets between said jaws and includes manually operable means for releasably retaining said jaws in said clamped position;

said first jaw is pivotably mounted on the first end of said platen to afford manual pivotal movement of said first and second jaws between a normal position with the engagement surface of said first jaw generally aligned with said support surface of said platen, and arching positions with the engagement surfaces of said first jaw oriented at various angles with respect to said support surface;

said frame includes a locating wall having a generally horizontal alignment surface located adjacent the second end of said platen when said platen is in said vertical position; and said device comprises a pressure bar having opposite ends and an elongate pressure surface between said ends, springs coupled between the ends of said pressure bar and attachment positions on said frame spaced along said support surface from the second end of said platen when said platen is in said vertical position to bias said pressure surface toward said attachment positions while affording movement of said bar away from said attachment positions in various directions in opposition to the biasing of said springs, the weight of said bar biasing said bar to a position with said pressure surface parallel to said support surface when said platen is in said vertical position; and a flexible sheet having one end attached to said pressure surface and an opposite end attached to the engagement surface of said second jaw;

said first and second jaws in said released position and said normal position, said flexible sheet, said alignment surface, and said support surface when said platen is in said vertical position providing said positioning means;

pivoting of said platen from said vertical to said horizontal position with said first and second jaws in said clamped position and said normal position provides said revolving means;

pivoting of said first and second jaws from said normal to one of said arching positions when said platen is in said horizontal position and said jaws are in said clamped position provides said arching means; and said pressure bar biased toward said attachment positions under the influence of said springs providing said limited clamping means.

* * * * *